US010124229B1

(12) United States Patent
McManaman

(10) Patent No.: US 10,124,229 B1
(45) Date of Patent: Nov. 13, 2018

(54) GOLF SWING TRAINING AID

(71) Applicant: Timothy John McManaman, Danvers, IL (US)

(72) Inventor: Timothy John McManaman, Danvers, IL (US)

( * ) Notice: Subject to any disclaimer, the term of this patent is extended or adjusted under 35 U.S.C. 154(b) by 30 days.

(21) Appl. No.: 15/667,616

(22) Filed: Aug. 2, 2017

(51) Int. Cl.
*A63B 69/36* (2006.01)
*A63B 69/00* (2006.01)

(52) U.S. Cl.
CPC ..... *A63B 69/3641* (2013.01); *A63B 69/3623* (2013.01); *A63B 69/00* (2013.01); *A63B 2225/09* (2013.01); *A63B 2225/093* (2013.01)

(58) Field of Classification Search
USPC ..... 473/207, 208, 268, 274
See application file for complete search history.

(56) References Cited

U.S. PATENT DOCUMENTS 3,443,811 A * 5/1969 Brooks ..... A63B 69/3608 473/274
3,897,948 A * 8/1975 Gerela ..... A63B 69/0073 473/419
4,049,267 A * 9/1977 Forrest ..... A63B 69/0075 473/419
6,413,175 B1 * 7/2002 Mooney, Jr. ..... A63B 69/0075 473/417
8,480,505 B2 * 7/2013 Huff ..... A63B 69/0057 473/266
2011/0111877 A1 * 5/2011 McManaman ..... A63B 69/3608 473/274

* cited by examiner

*Primary Examiner* — Nini Legesse

(57) ABSTRACT

A golf swing training aid for teaching a golfer to maintain a steady head when swinging a golf club. The golf swing training aid comprises an elongated straight rod attached to the ground, a curved hose section slidable over the elongated straight rod which can be extended and retracted, a hose arc section which is formed from the curved hose when the curved hose is extended longitudinally, a constant tension stopper imparting a stopping action when the curved hose is extended longitudinally, a ball attached to the end of the curved hose, wherein a golfer attaches the elongated rod to the ground, extends the slidable curved hose over the elongated straight rod forming a hose arc section, adjusting the hose arc section to the proper height for the golfer's head to come in contact with the ball providing a steadying action for the golfer to learn to maintain a steady head when swinging a golf club.

4 Claims, 4 Drawing Sheets

GOLF SWING TRAINING AID

CROSS-REFERENCE TO RELATED APPLICATIONS

Not applicable.

BACKGROUND OF THE INVENTION

Field of the Invention

The present invention relates generally to golf swing training aids, and more particularly to a training aid for training a golfer to maintain a steady head while practicing a golf swing.

Description of Related Art

Training aids are used by golfers when practicing to improve their golf swings. One method used by golfers to improve their golf swing is to learn to maintain a steady head during the golf swing which increases the accuracy and consistency of the golf swing. Several devices have been developed to help teach golfers to maintain a steady head during the golf swing. These devices vary widely and have numerous design features. A number of devices have been developed which come in contact with a golfers head through securing to the ground and using telescopic tubes with fasteners for adjustment. Other devices have been developed which secure to the ground and are adjustable through the use of hinged connectors or bendable metal conduit. As evidenced through the number of devices which have been developed, it is a desire of golfers to seek improved golf training aids for learning to maintain a steady head during the golf swing.

BRIEF SUMMARY OF THE INVENTION

An object of the present invention is to provide an improved golf swing training aid for learning to maintain a steady head during the golf swing.

It is another object of the present invention to provide an improved golf swing training aid which can be quickly connected to the ground.

A further object of the present invention to provide an improved golf training aid offering a unique adjustment feature requiring no screws, locks or other fastening devices. This unique feature offers the golfer the ability to quickly and easily adjust the training aid for use.

An even further object of the present invention is to provide an improved golf swing training aid offering yet another unique feature wherein a curved hose forms into an arc when extended, and the arc remains in position when extended and adjusted to the proper height for use by a golfer. This unique feature is further appreciated by understanding the hose manufacturing process and related physical attributes of hose. When hose is manufactured it is either cut into specified lengths or spun into a roll similar to that of a garden hose. Hose cut into specified lengths, when manufactured, remains straight and does not have a natural curve. Hose spun into a roll, when manufactured, maintains a natural curve. When a hose of a certain diameter and hardness is spun into a roll, the rolled hose is able to be straightened and then re-rolled back into a roll similar to that of a garden hose. This straightening and re-rolling feature is what allows the disclosed invention to provide a curved hose which can be straightened when slid upon a straight rod and then naturally formed into and arc when extended from upon the straight rod.

These and other objects of this invention shall become more apparent from the ensuing descriptions of the invention.

Accordingly, in general terms, an improved golf swing training aid is disclosed comprising an elongated straight rod which attaches to the ground, a curved hose slidably extendable and retractable over the elongated straight rod, a hose arc section formed from the curved hose when the curved hose is extended longitudinally, a constant tension stopper imparting a stopping action when the curved hose is extended longitudinally, a ball attached to the end of the curved hose, wherein a golfer attaches the elongated straight rod to the ground at an angular position, extends the slidable curved hose forming a hose arc section, adjusting the hose arc section to the proper height for the golfer's head to come in contact with the ball, providing a steadying action for the golfer to learn to maintain a steady head when swinging a golf club.

BRIEF DESCRIPTION OF THE SEVERAL VIEWS OF THE DRAWINGS

The unique features of the golf swing training aid are set forth in the claims. The invention itself, as well as its features will be best understood by the reference to the detailed drawings and accompanying description. It is appreciated that these drawings show preferred embodiments of the invention, however, should not be considered limiting, wherein:

DETAILED DESCRIPTION OF THE INVENTION

Figure 1:
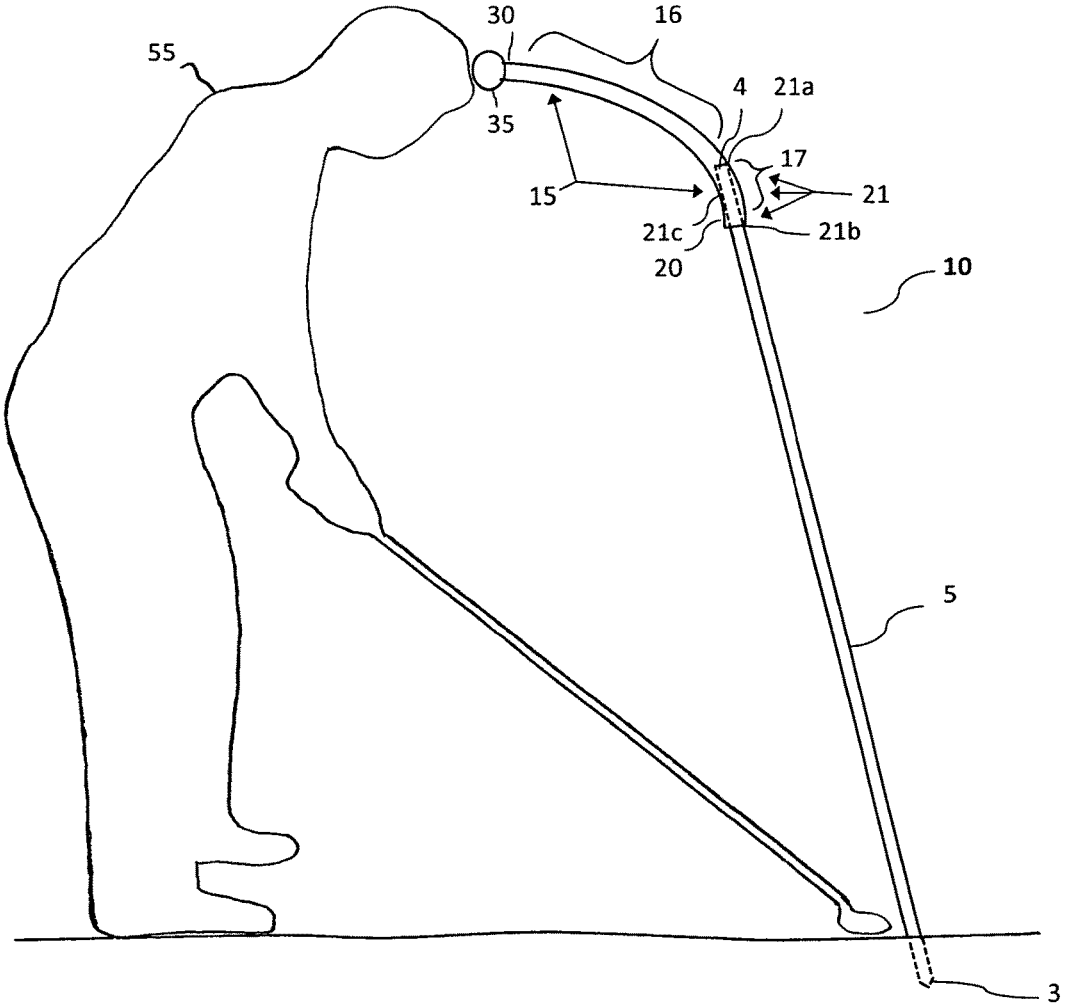
FIG. 1 shows a side view of the golf swing training aid 10 secured to the ground in an extended position.

With reference to FIG. 1 an improved golf swing training aid designated by numeral 10 is described. This embodiment of the invention comprises an elongated straight rod 5 having a first pointed end 3 securable to the ground, and a second end 4. The invention further comprises a curved hose 15 having multiple elements, the curved hose 15, comprises a curved straightenable hose section 17, and a hose arc section 16. The curved hose 15, having a first end 20 and a second end 30 wherein the first end 20 slides over the second end 4 of the elongated straight rod 5 and is slidably extendable and retractable longitudinally over the elongated straight rod 5 when a slidable force is applied. Additionally, the invention comprises a curved straightenable hose section 17 wherein the curved hose 15 forms into a straight shape when the curved hose 15 is slid retractably over the elongated straight rod 5. The invention also comprises a hose arc section 16 wherein the curved hose 15 forms into an arc shape when the curved hose 15 is extended longitudinally over the second end 4 of the elongated straight rod 5. The curved hose 15 naturally forms into the hose arc section 16 as a result of the hose manufacturing process wherein the hose is spun into a roll and maintains a natural curve. The curved hose 15 can be an approximate diameter of ½" to 1" and cut in lengths of approximately 2' to 4' from a spun roll with the spun roll having a diameter of approximately 2' to 3'. When a hose of an approximate ½" to 1" diameter is spun into a roll of an approximate 2' to 3' diameter when manufactured, and cut into an approximate length of 2' to 4', the 2' to 4' cut length of rolled hose is straightenable and arcable when slid on and off a straight rod such as the elongated straight rod 5.

Figure 3:
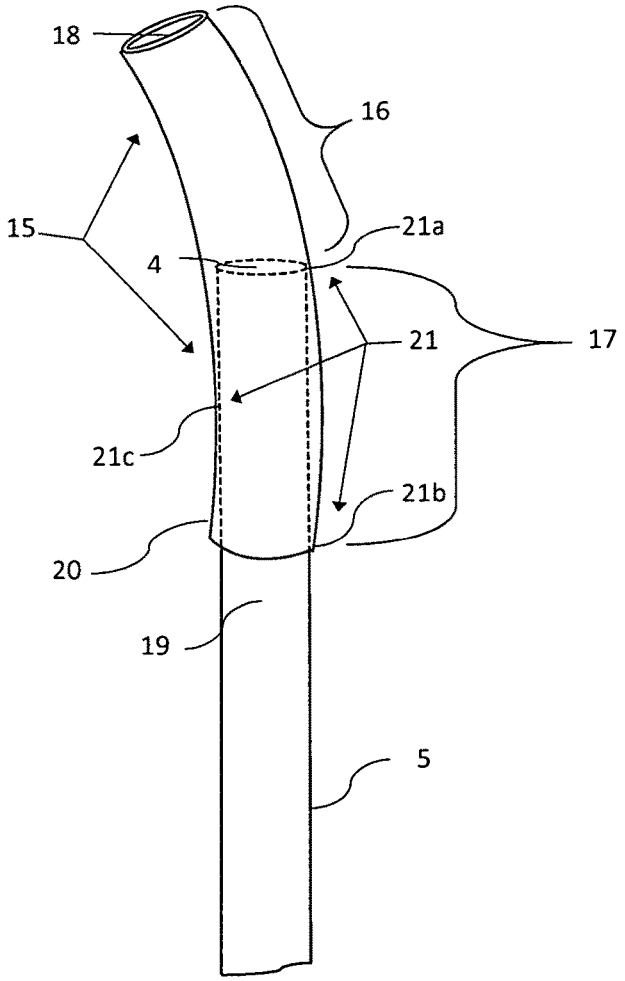
FIG. 3 is an enlarged side view showing the detail of the constant tension stopper 21.

Referring to FIG. 3, another feature of the invention is a constant tension stopper 21 comprising a first tension point 21*a*, a second tension point 21*b* and a third tension point 21*c* between the interior surface 18 of the curved hose 15 and the exterior surface 19 of the elongated straight rod 5 wherein the constant tension stopper 21 imparts a stopping action when the curved hose 15 is slid over the elongated straight rod 5 and the slidable force is removed, and the hose arc section 16 remains in place. This unique feature is a result of the curved hose 15 having an interior diameter approximately 1/16" to 3/16" larger than the diameter of the elongated straight rod 5. The slightly larger diameter of the curved hose 15 in combination with the natural curve of the curved hose 15 creates the constant tension stopper 21 when the curved hose 15 is slid over the elongated straight rod 5. The constant tension stopper 21 imparts a stopping action allowing the golfer 55 to adjust the golf swing training aid 10 and the golf swing training aid 10 remains at the adjusted height.

Another feature of the invention is a ball 35 attached to the second end 30 of the curved hose 15, wherein a golfer 55 attaches the elongated straight rod 5 to the ground, slidably extends the curved hose 15 over the second end 4 of the elongated straight rod 5 forming a hose arc section 16, adjusts the hose arc section 16 to the proper distance for the golfer's head to come in contact with the ball 35 providing a steadying action for the golfer 55 to learn to maintain a steady head when swinging a golf club.

Figure 2:
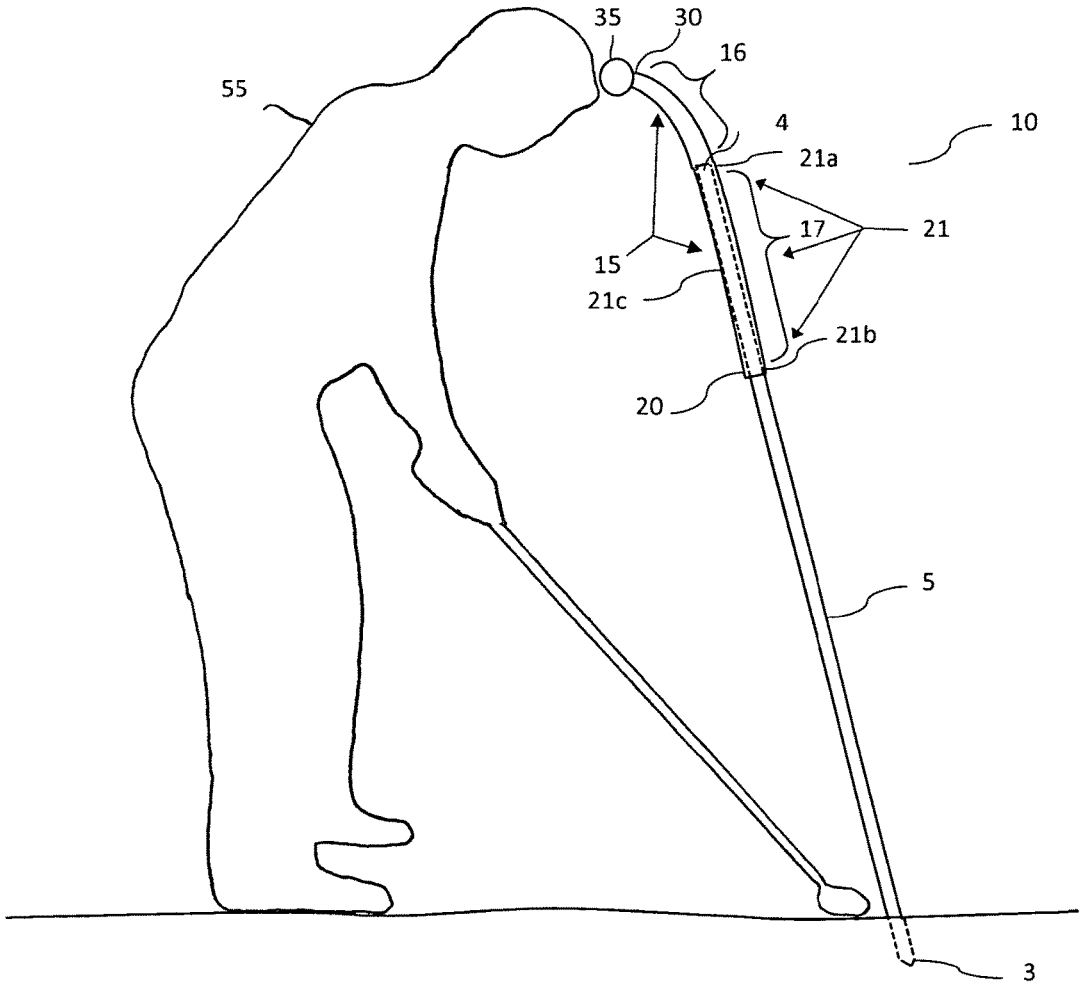
FIG. 2 shows a side view of the golf swing training aid 10 secured to the ground in a partially extended position.

Referring to FIG. 2, the golf swing training aid 10 is shown wherein the curved hose 15 is in a partially retracted position and partially slid upon the elongated straight rod 5.

Referring again to FIG. 3, the constant tension stopper 21 is shown in an enlarged detail whereas the first tension point 21*a*, the second tension point 21*b* and the third tension point 21*c* create sufficient tension to allow the curved hose 15 to remain in place when slid over the elongated straight rod 5.

Figure 4:
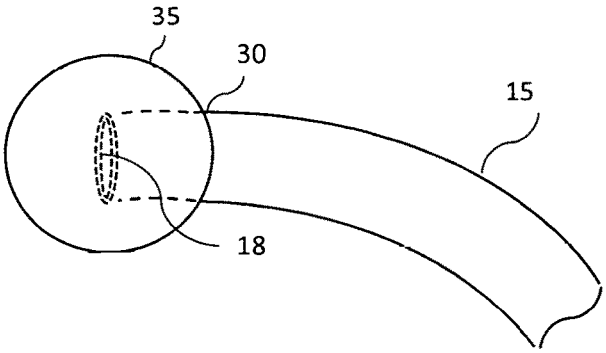
FIG. 4 is an enlarged side view showing the detail of the ball 35 attached to the second end 30 of the curved hose 15.

Referring to FIG. 4, the ball 35 is shown in an enlarged side view attached to the second end 30 of the curved hose 15. The ball 35 can be comprised of a plurality of materials such as foam or rubber and can be attached to the curved hose 15 by inserting the second end 30 of the curved hose 15 into the ball 35 and securing the curved hose 15 to the ball 35 with a plurality of adhesives. It is appreciated that the ball 35 can be attached to the curved hose 15 through other means such as a pressure fit or a male and female screw adapter.

Figure 5:
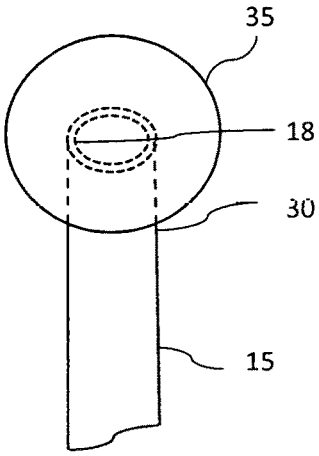
FIG. 5 is an enlarged front view of the detail of the ball 35 attached to the second end 30 of the curved hose 15.

Referring to FIG. 5, the ball 35 is shown in an enlarged front view further detailing the shape of the ball 35 attached to the second end 30 of the curved hose 15.

Figure 6:
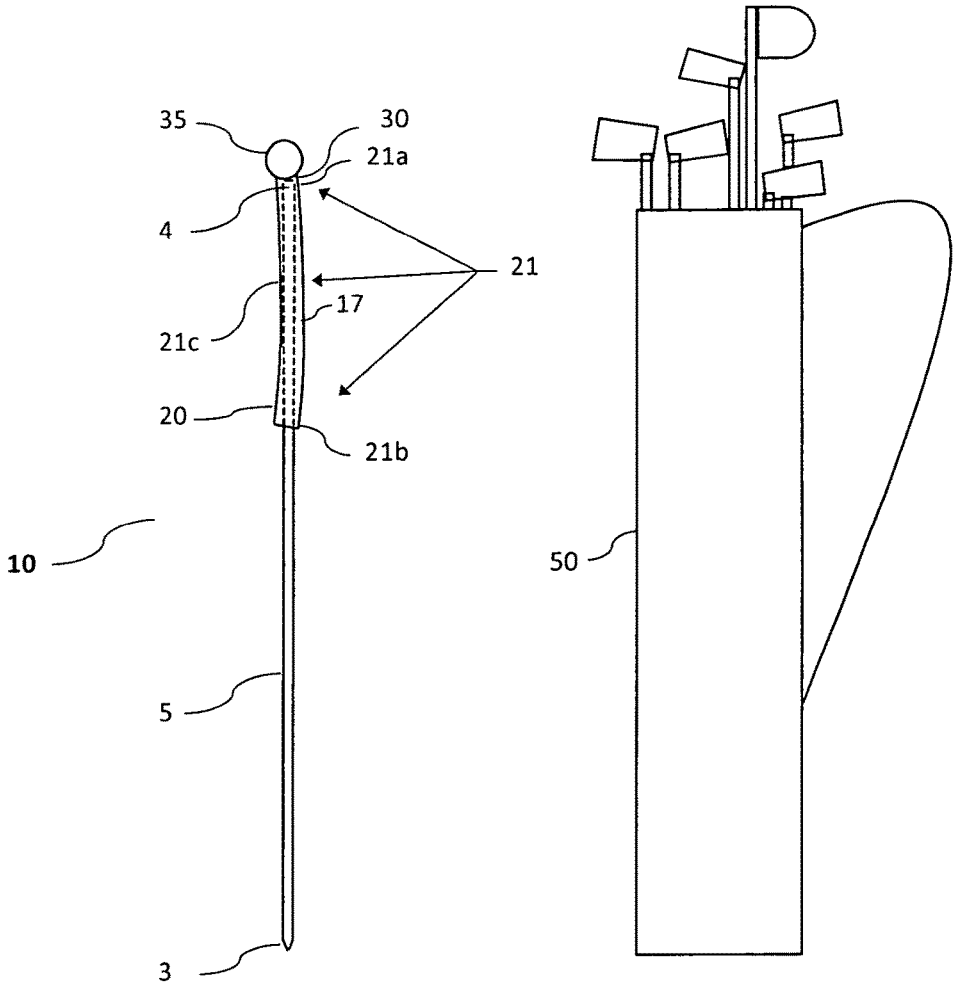
FIG. 6 shows a side view of the golf training aid 10 in a fully retracted position alongside a set of golf clubs 50 depicting the approximate height of the golf training aid 10 when in a retracted position.

Referring to FIG. 6, the golf swing training aid 10 is shown in a fully retracted position wherein the curved straightenable hose section 17 is formed when slid over the elongated straight rod 5. In the fully retracted position, the constant tension stopper 21 imparts a stopping action wherein the curved straightenable hose section 17 remains in place over the elongated straight rod 5 when the golf swing training aid 10 is removed from the ground and placed into a golf bag 50 for transport and use.

The invention claimed is:

1. A golf swing training aid comprising:

a. an elongated straight rod having an exterior surface, having a first pointed end securable to the ground at an angular position, and a second end;

b. a curved hose having multiple sections, the curved hose comprising a curved straightenable hose section and a hose arc section, the curved hose having an interior surface, a first end and a second end wherein the first end slides over the second end of the elongated straight rod and is slidably extendable and retractable longitudinally over the elongated straight rod when a slidable force is applied, the curved straightenable hose section wherein the curved hose forms into a straight shape when the curved hose is retractably slid over the elongated rod, the hose arc section extending sectionally from the second end of the curved hose towards the second end of the elongated straight rod wherein the curved hose forms into an arc shape when the curved hose is extended longitudinally over the second end of the elongated straight rod;

e. a constant tension stopper comprising a first tension point, a second tension point and a third tension point between the interior surface of the curved hose and the exterior surface of the elongated straight rod wherein the constant tension stopper imparts a stopping action when the curved hose is slid over the elongated straight rod and the slidable force is removed, and the hose arc section remains in place when in an extended, retracted or partially retracted position;

f. a ball attached to the second end of the curved hose, wherein a golfer attaches the elongated straight rod to the ground at an angular position, slidably extends the curved hose longitudinally over the elongated straight rod forming a hose arc section, adjusts the hose arc section to the proper distance for the golfer's head to come in contact with the ball providing a steadying action for the golfer to learn to maintain a steady head when swinging a golf club.

2. The golf swing training aid of claim 1 wherein the curved hose is comprised of a plastic or rubber material wherein the hose arc section maintains an arc shape.

3. The golf swing training aid of claim 1 wherein the elongated straight rod is comprised of a rigid fiberglass material.

4. The golf swing training aid of claim 1 wherein the hose arc section is of a radius between twelve and eighteen inches.

* * * * *